US006721971B1

(12) United States Patent
Cheng

(10) Patent No.: US 6,721,971 B1
(45) Date of Patent: Apr. 20, 2004

(54) UPPER CORNER ELEMENT OF A BABY BED

(76) Inventor: Pao-Hsien Cheng, No. 139, Jen Yi 1st Street, Jen Te Hsiang, Tainan Hsien (TW)

( * ) Notice: Subject to any disclaimer, the term of this patent is extended or adjusted under 35 U.S.C. 154(b) by 0 days.

(21) Appl. No.: 10/358,299

(22) Filed: Feb. 5, 2003

(51) Int. Cl.[7] ..... A47D 9/02
(52) U.S. Cl. ..... 5/99.1; 5/93.1; 5/98.1
(58) Field of Search ..... 5/99.1, 97, 98.1, 5/93.1; 405/205, 231, 239, 329

(56) References Cited

U.S. PATENT DOCUMENTS 5,752,283 A * 5/1998 Arens ..... 5/99.1
6,430,762 B1 * 8/2002 Cheng ..... 5/93.2
6,467,108 B1 * 10/2002 Wang ..... 5/99.1

* cited by examiner

*Primary Examiner*—Teri Pham Luu
*Assistant Examiner*—Fredrick Conley
(74) *Attorney, Agent, or Firm*—Rosenberg, Klein & Lee

(57) ABSTRACT

A baby bed has four upper corner elements joined to horizontal and vertical rods. Each upper corner element includes a main body, and an ornamental cover detachably fitted over the main body; the main body has a connecting hole on a bottom extension, and the ornamental cover has a hook for engaging the connecting hole of the main body. Two ends of the main body are formed with narrow slots, and two ends of each horizontal support rods are formed with thin and flat shape; the horizontal support rods are inserted into the slots of the main body at the plate-shaped end portions, and pivotally connected to the main body with pivotal pins. Dimensions of the baby bed can be reduced when it is in a folded position because the slots of the main body occupy relatively little space as compared with a round hole.

2 Claims, 5 Drawing Sheets

UPPER CORNER ELEMENT OF A BABY BED

BACKGROUND OF THE INVENTION

1. Field of the Invention

The present invention relates to an upper corner element of a baby bed, more particularly one, which consists of a main body for connection to horizontal and vertical support rods of the baby bed, and an ornamental cover detachably fitted over the main body; the main body is formed with narrow slots, and the horizontal support rods are formed with plate-shaped ends so that the upper corner element can be reduced in width.

2. Brief Description of the Prior Art

Upper corner elements, which usually have a right angle in the middle, are provided to baby beds for connecting horizontal support rods to vertical support rods of the baby beds. Conventional upper corner elements are made with a single part and a single color therefore they don't have additional functions, e.g. being ornamental, besides connecting horizontal support rods to vertical support rods of baby beds. And, conventional upper corner elements are made with round connecting rooms at two ends for cylindrical horizontal support rods to be inserted into therefore they are relatively wide, and in turn, baby beds can't be reduced to satisfactorily compact size when they are in the folded position owing to the size of the upper corner elements.

Another form of upper corner elements are provided to baby bed, which consist of an inner main body and an ornamental cover securely fitted over the main body; the ornamental cover and the main body are formed of different colors and with more curvatures between the joints so that the upper corner elements are more attractive. However, such upper corner elements are still relatively wide for the same reasons described above, and in turn, baby beds equipped with them can't be reduced to satisfactorily compact size when they are in the folded position. And, the ornamental cover can't be detached from the main body therefore the users have to replace a whole upper corner element with a new one even if only one of the parts is damaged, causing waste of money.

SUMMARY OF THE INVENTION

It is an object of the present invention to provide an upper corner element to a baby bed, which includes an inner main body for connection to upper horizontal support rods of a baby bed; the main body is formed with narrow slots, and the horizontal support rods are formed with plate-shaped ends so that the upper corner element can be reduced in width, not causing problems to providing a baby bed that is compact in the folded position.

It is another object of the present invention to provide an upper corner element to a baby bed, which includes an inner main body, and an ornamental cover, which easily separably fitted over the main body for allowing the upper corner element to be maintained easily.

It is yet another object of the present invention to provide an upper corner element to a baby bed, which has a cover separably fitted over an inner main body; the cover is tightly pressed against the main body at the edges of lateral walls thereof to have no apertures left at the joints therefore babies or children can't insert objects between the cover and the main body to cause damage to the corner element. And, the holding cloth part of the baby bed always covers the horizontal support rods even though the baby bed is in the folded position because the present upper corner element is used for fixing the upper corners of the holding cloth part in position.

BRIEF DESCRIPTION OF THE DRAWINGS

The present invention will be better understood by reference to the accompanying drawings, wherein.

DETAILED DESCRIPTION OF THE PREFERRED EMBODIMENTS

Figure 1:
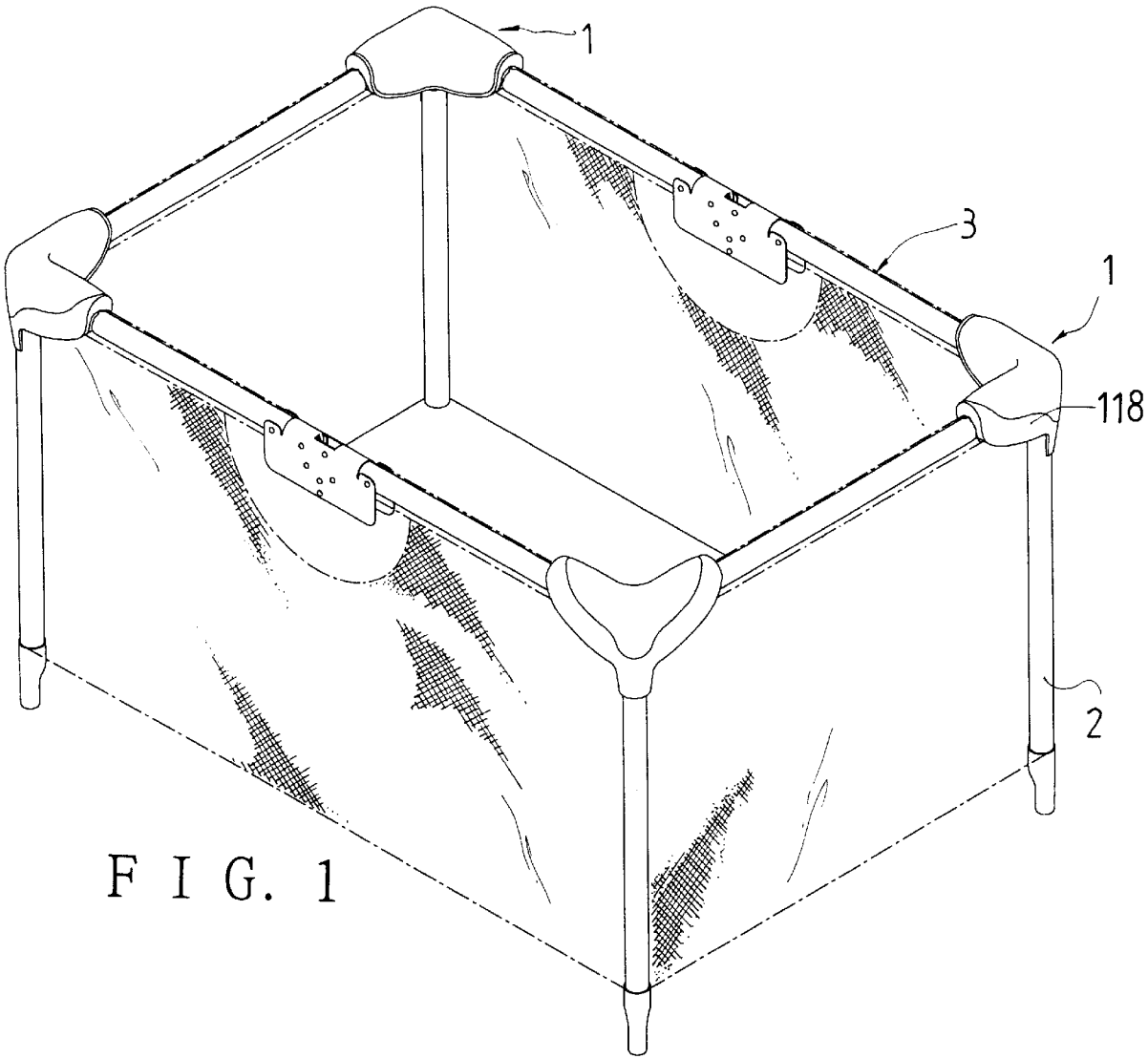
FIG. 1 is a perspective view of a baby bed of the present invention.
Figure 3:
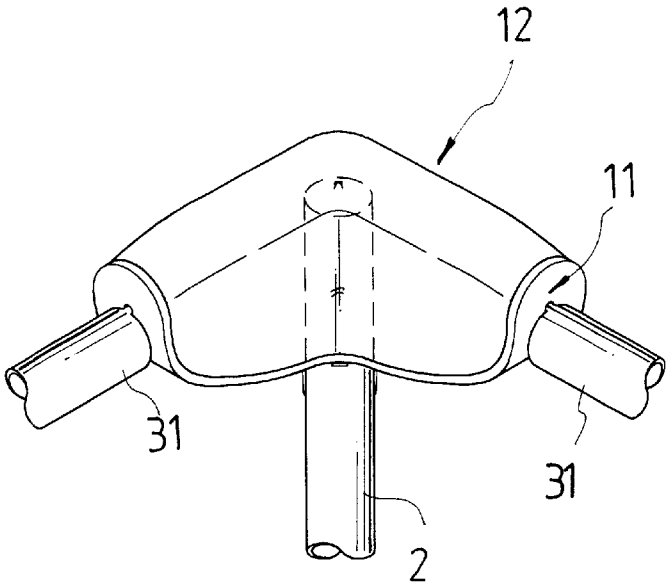
FIG. 3 is a perspective view of the upper corner element of a baby bed according to the present invention.
Figure 2:
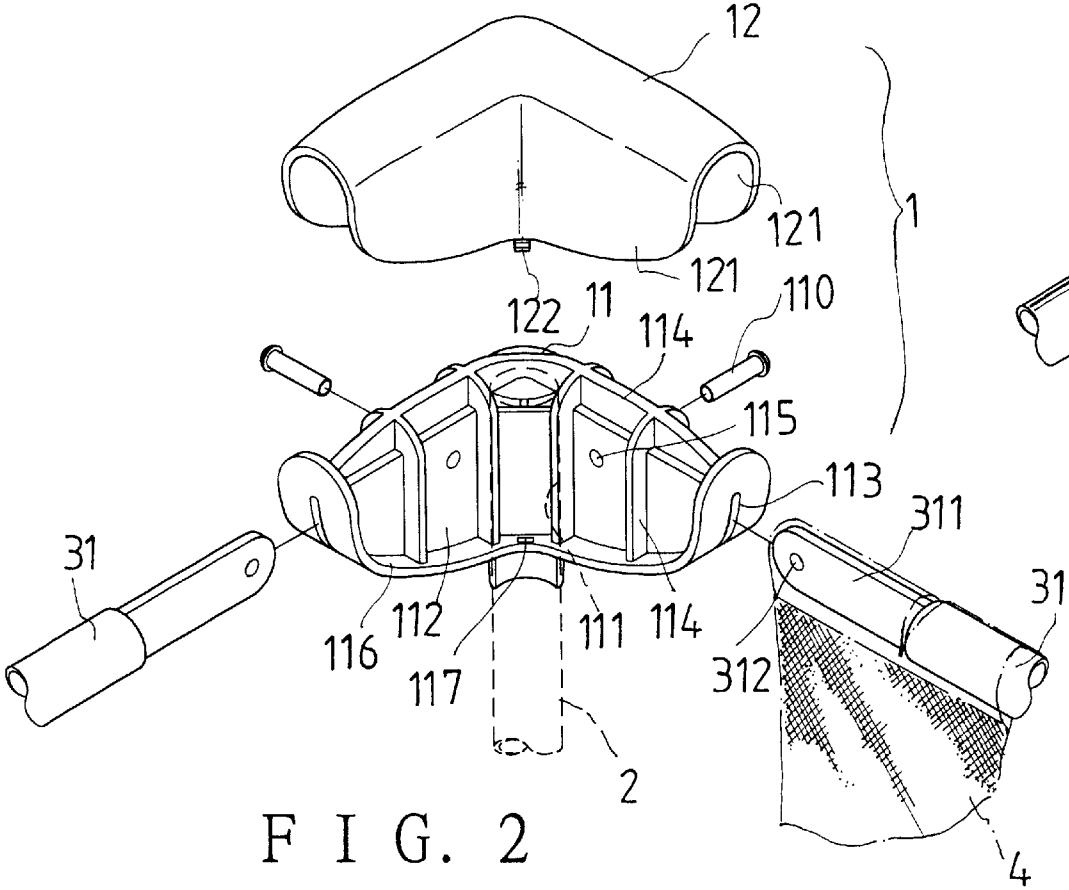
FIG. 2 is an exploded perspective view of the upper corner element of a baby bed according to the present invention.
Figure 5:
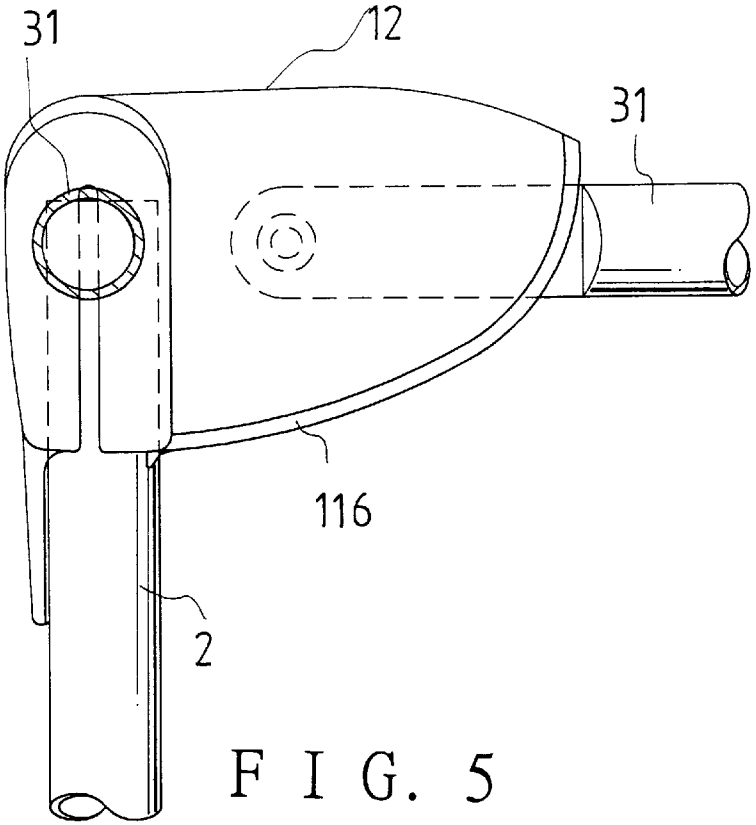
FIG. 5 is a side view of the upper corner element of the present invention.
Figure 4:
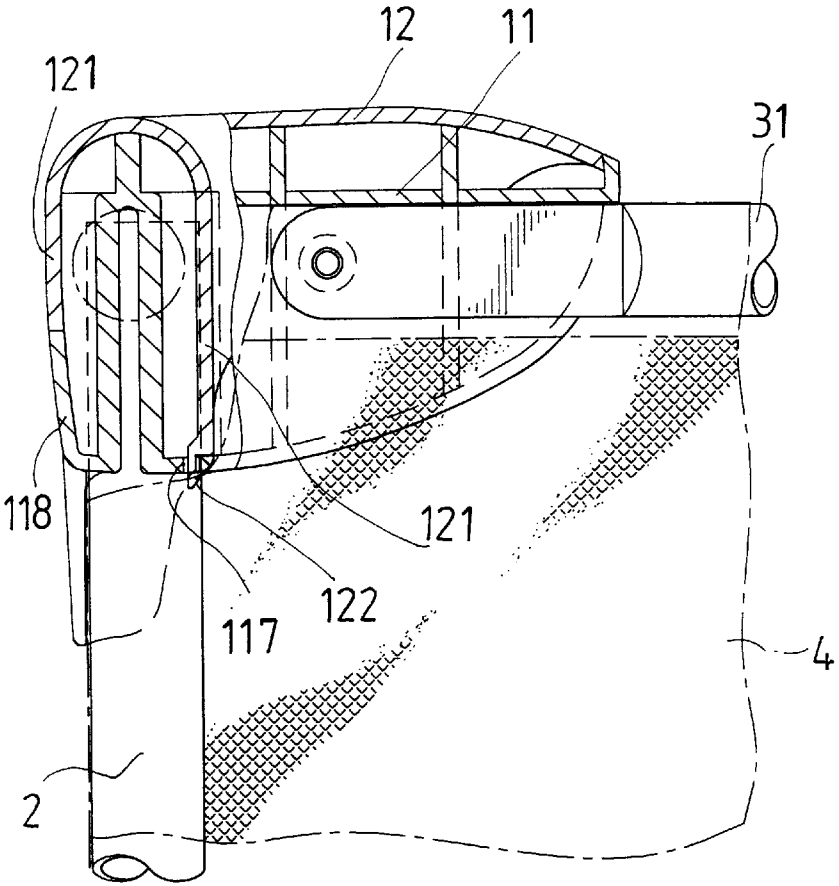
FIG. 4 is a cross-sectional view of the upper corner element of a baby bed according to the present invention.
Figure 6:
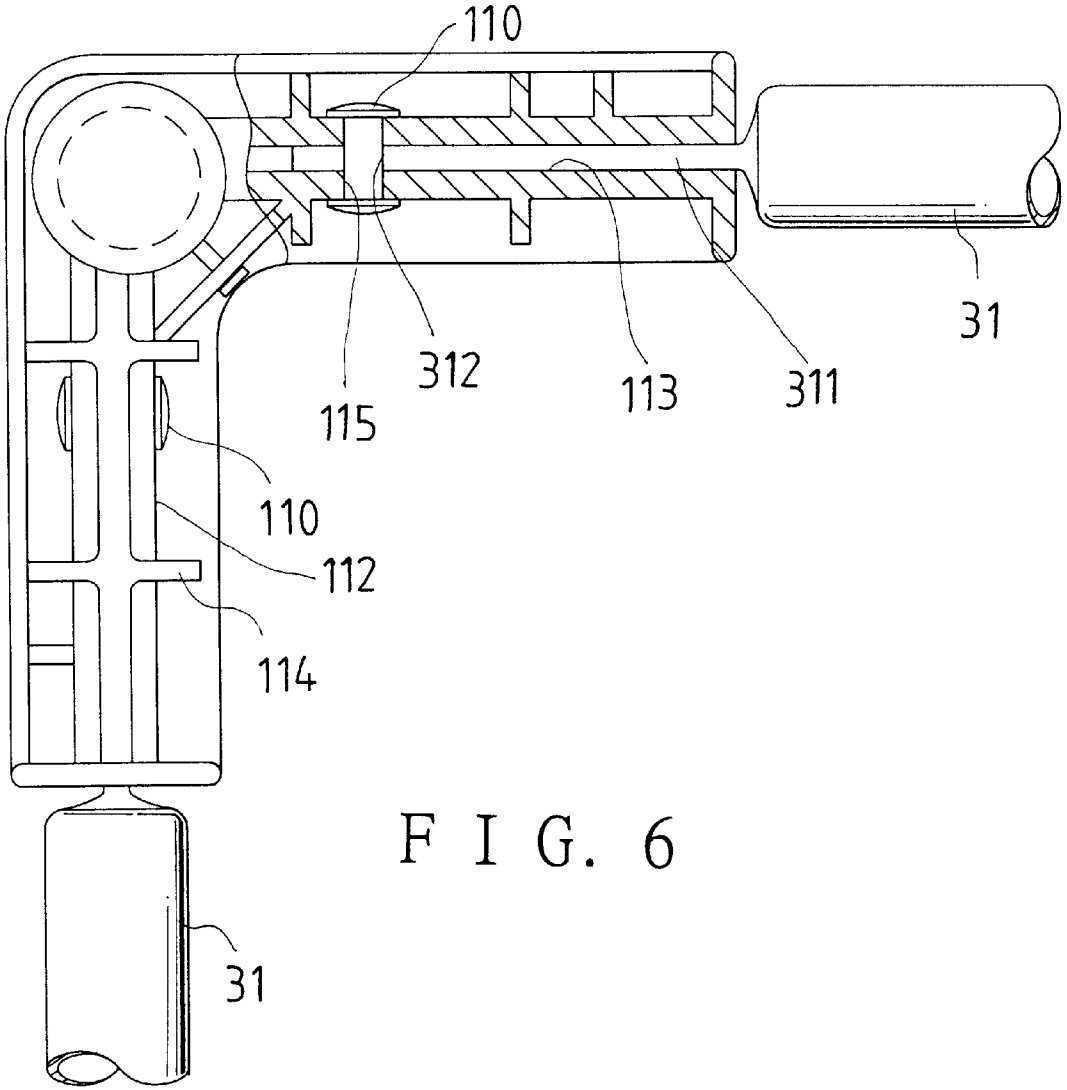
FIG. 6 is another cross-sectional view of the upper corner element of a baby bed according to the present invention; and, FIG. 7 is a view showing the way the upper corner element of the present invention is disassembled.
Figure 7:
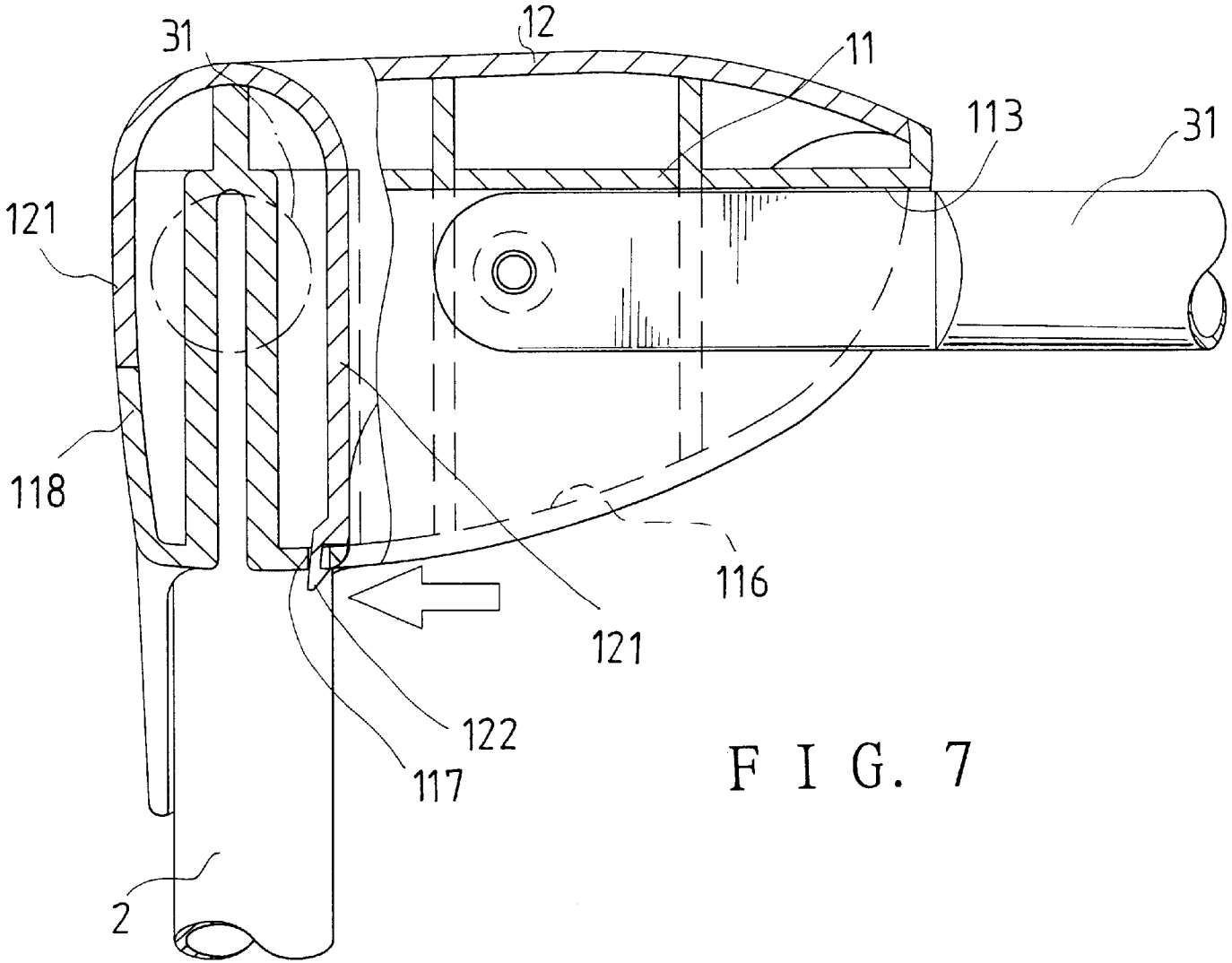

Referring to FIGS. 1 to 4, an upper corner element 1 of a baby bed according to the present invention includes an inner main body 11, and an ornamental cover 12;

The main body 11 is formed with a single part, and has an angle at a middle thereof, an insertion hole 111 in the middle, two lateral walls 112, a bottom joined to the lower ends of the lateral walls 112, slots 113 between first ends of the lateral walls 112 as well as between second ends of the lateral walls 112, strengthening ribs 114 projecting from the lateral walls 113, aligned holes 115 on the first ends and the second ends of the lateral walls 112, an inward extension portion 116 projecting from the bottom thereof, a connecting hole 117 formed on the inward extension portion 116 of the bottom, and an outer extension portion 118 also projecting from the bottom thereof; the bottom is also formed with slots for allowing insertion of plate-shaped objects into between the lateral walls 112; the strengthening ribs 114 are provided for increasing the strength of the main body 11; the insertion hole 111 is provided for connection to an upper end of a vertical support rod 2 of a baby bed.

The ornamental cover 12 is made with a single part, and has an angle in a middle thereof like the main body 11, and outward and inward lateral walls 121, which define holding rooms (not numbered) between first ends thereof and between second ends thereof. The ornamental cover 12 further has a hook 122 on a lower end of an inner one of the lateral walls 121.

An upper frame part 3 of a baby bed has to be provided with such horizontal support rods 31 as are shown in the figures in order for allowing the upper corner element. 1 of the present invention to be used; each horizontal support rod 31 has insertion end portions 311 at two ends, which are in the form of a plate, and are relatively thin as compared with the middle cylindrical portions of the rods 31; each insertion end portion 311 has a through hole 312.

In combination, first, two horizontal support rods 31, including the insertion end portions 311, are inserted into respective upper tube-shaped portions of a holding cloth part 4. Then, the horizontal support rods 31 are inserted into respective ones of the slots 113 of the main body 11 at insertion end portions 311 thereof, and pivotal pins 110 are passed through the through holes 312 and the holes 115 so that the horizontal support rods 31 can pivot on the upper corner element 1; the upper tube-shaped portions of the holding cloth part 4 and a small portion of the holding cloth part 4 adjacent to them will be also inserted into the slots 113 therefore they cannot separate from the upper corner element 1. Finally, the ornamental cover 12 is fitted over the main body 11 with the hook 122 engaging the connecting hole 117 of the main body 11; the inward lateral wall 121 of the cover 12 will be tightly pressed against the extension portion 116 of the main body 11 while the outward lateral wall 121 will be tightly pressed against the extension portion 118 of the main body 11.

To detach the ornamental cover 12 from the main body 11, the hook 122 is first pressed for the cover 12 to be disengaged from the connecting hole 117.

From the above description, it can be easily understood that the upper corner element of a baby bed of the present invention has advantages as followings:

1. The ornamental cover 12 can be easily separated from the main body 11 therefore the former can be replaced with a new one if it is damaged, i.e. the present upper corner element is more economical to use.
2. The consumers can choose among different color ornamental covers to match the main body and the baby bed.
3. Because the upper tube-shaped portions of the holding cloth part 4 are inserted into the slots 113 of the main body 11, the holding cloth part 4 can cover the horizontal support rods 31 even though the baby bed is in the folded position. In other words, the horizontal support rods 31 won't show to affect the appearance of the baby bed badly.
4. The upper corner element occupies smaller space than the prior art one because the main body 11 is formed with narrow slots 113 for the plate-shaped ends 311 of the horizontal support rods 31 to be inserted, not causing problems to providing a baby bed that is compact in the folded position.
5. The cover 12 is tightly pressed against the main body 11 at the edges of the lateral walls 121 to have no apertures left at the joint therefore the present upper corner element can emit the feeling of solidity.

What is claimed is:

1. An improvement on an upper corner element of a baby bed, comprising a main body joined to an upper end of a vertical support rod of a baby bed at a middle portion; the main body being shaped to have a right angle at the middle portion; the main body including juxtaposed inward and outward lateral walls, a bottom joined to the lower ends of the lateral walls, and slots between first ends of the lateral walls as well as between second ends of the lateral walls; the bottom having inward and outward extension portions projecting from it; the inward extension portion of the bottom having a connecting hole; the bottom having slots right under the slots between the lateral walls; and, an ornamental cover detachably fitted over the main body; the ornamental cover being shaped to have a right angle in a middle portion; the ornamental cover having juxtaposed inward and outward lateral walls defining holding rooms at first ends thereof and at second ends thereof for receiving the main body therein; the ornamental cover having a hook on a lower end of an inner one of the lateral walls for engaging the connecting hole of the main body;

horizontal support rods of the baby bed being inserted into the slots of the main body at plate-shaped end portions thereof, and pivotally connected to the main body with pivotal pins; a holding cloth part, which is hung on the horizontal support rods, being inserted into the slots of the main body at upper ends of edges thereof together with the plate-shaped end portions of the horizontal support rods so that it is secured to the main body;

lower ends of the lateral walls of the ornamental cover being tightly pressed against respective extension portions of the bottom of the main body.

2. The upper corner element of a baby bed as claimed in claim 1, wherein the lateral walls have strengthening ribs projecting from them.

* * * * *